US006484713B1

(12) United States Patent
Schmitt et al.

(10) Patent No.: US 6,484,713 B1
(45) Date of Patent: Nov. 26, 2002

(54) FUME EXHAUST DEVICE FOR USE ABOVE A RANGE

(75) Inventors: Christoph Schmitt, Stein; Dietrich Schmid, Ehningen; Peter Rohrbach, Koenigsbach-Stein, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/523,155

(22) Filed: Feb. 22, 2000

(30) Foreign Application Priority Data

Feb. 19, 1999 (DE) ..... 199 07 149

(51) Int. Cl.[7] ..... F24C 15/20
(52) U.S. Cl. ..... 126/299 R; 126/299 D
(58) Field of Search ..... 126/299 R, 299 D, 126/299 E, 299 F; 454/67, 49, 56; 55/DIG. 36

(56) References Cited

U.S. PATENT DOCUMENTS 3,625,135 A * 12/1971 Carlson ..... 126/299 D
3,826,180 A * 7/1974 Hayashi ..... 126/299 E
4,105,015 A * 8/1978 Isom ..... 126/299 D
4,903,685 A * 2/1990 Melink ..... 126/299 D
5,074,281 A * 12/1991 Fluhrer et al. ..... 126/299 D
5,139,009 A * 8/1992 Walsh ..... 126/299 R
5,619,982 A * 4/1997 Kelly et al. ..... 126/299 D
5,690,093 A * 11/1997 Schrank et al. ..... 126/299 D

* cited by examiner

*Primary Examiner*—Henry Bennett
*Assistant Examiner*—Josiah C. Cocks
(74) *Attorney, Agent, or Firm*—Laurence A. Greenberg; Werner H. Stemer; Gregory L. Mayback

(57) ABSTRACT

A fume exhaust hood is equipped with a fume detecting sensor element that controls the fan and, additionally, with a sensor element that directly or indirectly detects continuous activation of the range area connection and serves as a control member of a control circuit to start up the fume exhaust hood.

6 Claims, 1 Drawing Sheet

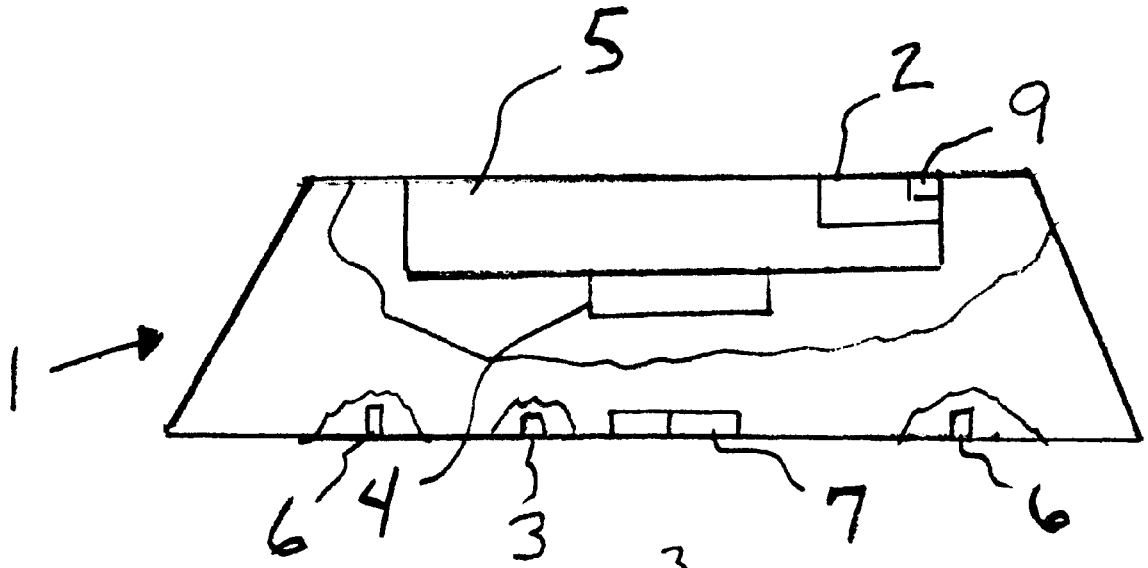
5
2
9
1
6
4
3
7
6
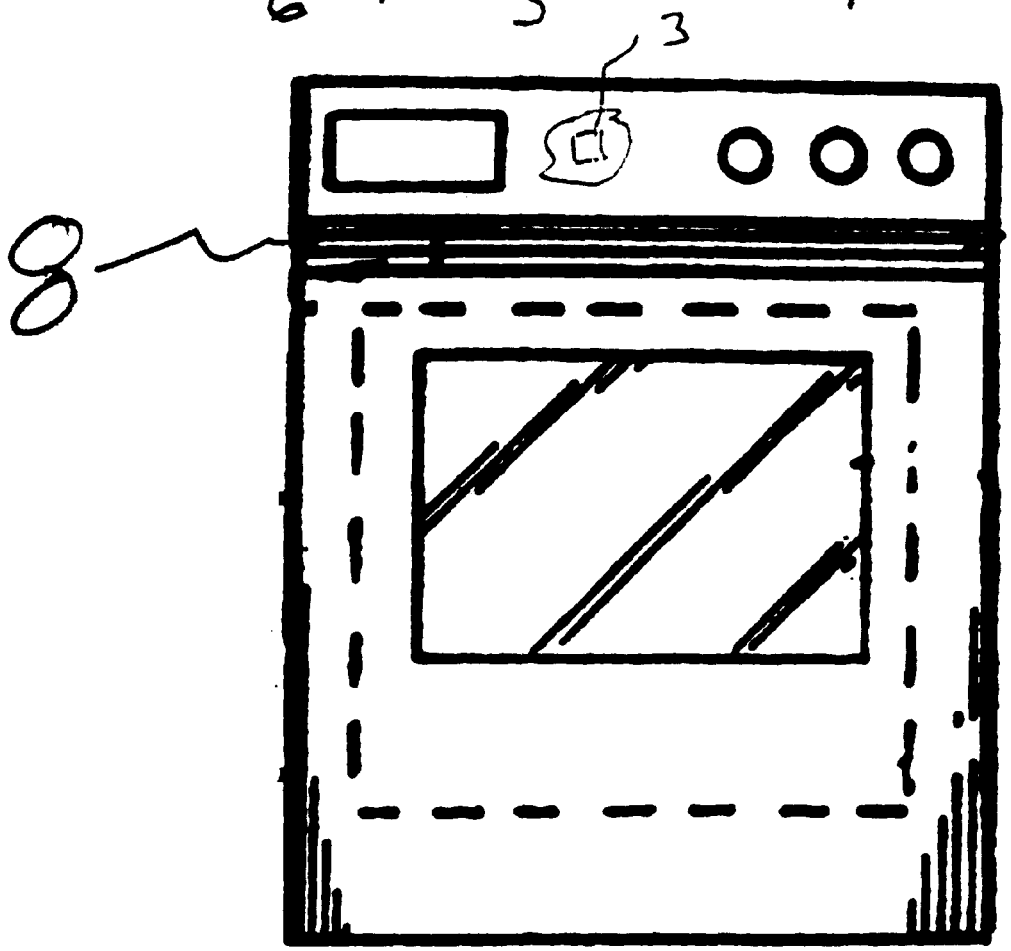
3
8

FUME EXHAUST DEVICE FOR USE ABOVE A RANGE

BACKGROUND OF THE INVENTION

Field of the Invention

The present invention relates to a fume exhaust hood device for use above a range (stove top) wherein the fume exhaust device can be started with the aid of a module receiving an activation signal from the range.

Fume exhaust devices may be configured as exhaust hoods or as exhaust chimneys that are disposed above the range or another open cooking area, such as a deep-fat fryer or an open grill, to take up the cooking fumes from the cooking area, filter them and either direct them out of the room toward the outside or return them odor-free to the room. Such fume exhaust devices are sufficiently known.

The currently used fume exhaust devices generally have a manual fan control that permits an incremental adjustment of the speed and thus the control of the air flow through the fume exhaust device and the adjustment to individual requirements. However, fume exhaust devices have become known, which respond to the state of the cooking process that takes place in the cooking area. German Utility Model DE 76 33 882 discloses an exhaust hood for a range disposed underneath the exhaust hood and the exhaust hood has a sensor of a moisture filling device. The sensor controls the operation of the exhaust hood via an evaluation circuit. This is to provide a state-dependent control of the exhaust hood.

It is furthermore known to equip an exhaust hood with a temperature sensor (see Published, Non-Prosecuted German Patent Application DE 25 18 750 A). It is also known from Published, Non-Prosecuted German Patent Application DE 29 51 409 A to disposed a so-called residual heat indicator on a stove top, which signals the heating state of a burner to the user until safe temperature values have been reached. In connection therewith, Published, Non-Prosecuted German Patent Application DE 32 45 302 A discloses a configuration of a photoelectric sensor in an exhaust hood that responds to a signal generator located in the burner, e.g., the residual heat indicator.

It is furthermore known to provide a transmission connection between the range and the exhaust hood so that the exhaust hood can be controlled via the stove top or its input elements and controls. This connection can be galvanic, i.e. in the form of wires, or wireless, by radio, ultrasound or photoelectric techniques.

SUMMARY OF THE INVENTION

It is accordingly an object of the invention to provide a fume exhaust device for use above a range which overcomes the above-mentioned disadvantages of the prior art devices of this general type, which has improved functionality and user friendliness of the fume exhaust device in connection with a range located underneath it.

With the foregoing and other objects in view there is provided, in accordance with the invention, a fume exhaust hood device for use above a range, including:

an exhaust device for evacuating fumes;

a fume detecting sensor element;

a control circuit for starting up and operating the exhaust device and connected to the fume detecting sensor element; and an additional sensor element that one of directly and indirectly continuously detects an operating state of the range and serves as a control member of the control circuit for starting up the exhaust device, the control circuit is functionally configured such that in a presence of a range-on operating state detected by the additional sensor element, for a duration of the range-on operating state, the control circuit functioning in an automatic operating state that activates and controls the exhaust device.

According to the invention, a fume exhaust device that satisfies these requirements to a high degree is characterized in that the fume exhaust device is equipped with a fume detecting sensor element and, additionally, with a sensor, element that directly or indirectly detects continuous activation of the range area connection. The additional sensor element serves as a control member of a control circuit to start up the fume exhaust device and in that the control circuit is functionally configured in such a way that in the presence of the range area connection criterion (i.e. the range is in an operating state) detected by the additional sensor element, for the duration of the connection, the control circuit for the automatic control of the exhaust device is activated.

With such a measure in a fume exhaust device, the additional sensor element is typically kept in continuous stand-by operation via a mini-power pack so that the additional sensor element can detect a typical range area connection criterion at any time. Such a criterion can be, for example, the residual heat indicator, but this requires that a relevant heat output is already being supplied to the range. It is more practical to detect the startup of the range control itself, i.e., to respond, for example, to the actuation of a main switch or other input members. The states that are thus established without any heat outputs can be detected and evaluated by simple devices known in the art and can thus be provided to the additional sensor element of the fume exhaust device, preferably by radio techniques. For the duration of the connection (switched on state) of the range, this signal is thus available and is registered by the additional sensor element of the fume exhaust device and supplied to the control circuit. The absence of this signal causes the additional sensor element to switch off the automatic function of the fume exhaust device. In this case, it is provided that the fume exhaust device can be manually set to the desired power values. Other features which are considered as characteristic for the invention are set forth in the appended claims.

Although the invention is described herein as embodied in a fume exhaust device for use above a range, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

BRIEF DESCRIPTION OF THE DRAWINGS

The single FIGURE of the drawing is a diagrammatic, partially broken-away, front-elevational view of a fume exhaust device disposed above a range according to the invention.

DESCRIPTION OF THE PREFERRED EMBODIMENTS

Referring now to the single FIGURE of the drawing in detail, there is shown a preferred embodiment of a fume exhaust device 1 according to the invention. The fume exhaust device 1 is characterized in that its control circuit 2 is functionally configured in such a way that in the presence of a range area connection criterion detectable by an additional sensor element 3, an illuminating device 4 of the fume exhaust device 1 is activated for a duration of the connection. Illuminating devices are conventional components of fume exhaust devices—both in hood and chimney form. The preferred embodiment has the result that as a convenience, when a burner is turned on, a light 4 is switched on and remains on simultaneously. It is a safety measure, but also serves to indicate in a manner visible from a distance that a range 8, intentionally or unintentionally, is still turned on. The control circuit 2 controls automatically and manually an exhaust device 5 for removing fumes such as an exhaust fan 5. At least one fume detecting sensor element 6 is provided and is connected to the control circuit 2. Alternatively, the fume detecting sensor element 6 and the additional sensor element 3 may be incorporated into the control circuit 2. Further, the additional sensor element 3 may be disposed in the range 8 and transmit signals from the range 8 to the control circuit 2.

According to another preferred embodiment, the fume exhaust device 1 according to the invention is characterized in that manual input members 7, e.g., in a form of pushbutton switches, slide switches, touch sensitive switches or the like, are assigned to the control circuit, with which the automatic operation and/or the illuminating device 4 can be manually controlled and/or functions can be permanently turned on or off, preferably also beyond the duration of the range area connection.

It cannot always be assumed that the fume exhaust device 1 is disposed above the range 8 in such a manner that an analyzable signal for the additional sensor element 3 is provided. There may be circumstances that temporarily or even permanently disable an output of a corresponding signal.

To prevent the fume exhaust device 1 equipped according to the invention from failing in its basic functions even under these circumstances, a further development of the fume exhaust device 1 according to the invention is equipped in such a way that the control circuit 2 is functionally configured such that after the start of a voltage supply, the fume exhaust device 1, until a first-time receipt of a range area connection criterion, regular functions and automatic operation can be manually switched on or off by the manual input members 7. Therefore, the fume exhaust device 1 that is equipped with the features according to the invention can originally be operated like an exhaust device without these functional measures. Only when the receipt of the range area connection criterion is detected for the first time by the additional sensor element 3, the control circuit 2 is influenced in that automatic operation ensues in the presence of the range area connection criterion, preferably exclusively iteratively. If a subsequently occurring error source causes the signal to be absent, the initial situation for manual operation may be restored by briefly interrupting the power supply to simulate a first-time connection.

According to another further development of the invention in this connection, the fume exhaust device 1 is characterized in that the control circuit 2 is functionally configured and equipped with a timing element 9 that is coupled to the additional sensor 3, such that when the range area connection criterion is absent, until renewed receipt of the range area connection criterion, regular functions and automatic operation can be manually switched on and off via the manual input members 7.

We claim:

1. A fume exhaust hood device for use above a range, comprising:

an exhaust device for evacuating fumes;

a fume detecting sensor element for detecting fumes;

a control circuit for starting up and operating said exhaust device, said control circuit connected to said fume detecting sensor element; and an additional sensor element that one of directly and indirectly continuously detects an operating state of the range and serves as a control member of said control circuit for starting up said exhaust device, said control circuit connected to said additional sensor and programmed to automatically activate and control said exhaust device based upon an amount of the fumes detected by said fume detecting sensor element when said additional sensor element detects a range-on operating state for a duration of the range-on operating state.

2. The fume exhaust device according to claim 1, including an illuminating device, said control circuit being functionally configured such that in the presence of the range-on operating state detectable by said additional sensor element, said illuminating device is activated for the duration of the range-on operating state.

3. The fume exhaust device according to claim 2, including manual input members selected from the group consisting of pushbutton switches, sliding switches, and touch sensitive switches connected to said control circuit, with which at least one of the automatic operating state of said control circuit and said illuminating device can be manually influenced and functions can be permanently switched on and switched off.

4. The fume exhaust device according to claim 3, wherein said manual input members can control said control circuit such that said illuminating device and said exhaust device can operate beyond the duration of the range-on operating state.

5. The fume exhaust device according to claim 3, wherein said control circuit is functionally configured such that after a start of a voltage supply, said exhaust device, until a first-time receipt of the range-on operating state, can be manually switched on and off via said manual input members.

6. The fume exhaust device according to claim 1, wherein said control circuit is functionally configured and equipped with a timing element that is coupled with said additional sensor element, such that in an absence of the range-on operating state, until a renewed receipt of the range-on operating state, regular functions of said exhaust device and the automatic operating state of the control circuit can be manually switched on and off via said manual input members.

* * * * *